US012070068B2

(12) United States Patent
Liu

(10) Patent No.: US 12,070,068 B2
(45) Date of Patent: Aug. 27, 2024

(54) ATOMIZATION DEVICE

(71) Applicant: Shenzhen Jingke Industrial Co., Ltd., Guangdong (CN)

(72) Inventor: Guiming Liu, Guangdong (CN)

(73) Assignee: Shenzhen Jingke Industrial Co., Ltd., Shenzhen (CN)

( * ) Notice: Subject to any disclaimer, the term of this patent is extended or adjusted under 35 U.S.C. 154(b) by 337 days.

(21) Appl. No.: 17/717,156

(22) Filed: Apr. 11, 2022

(65) Prior Publication Data

US 2022/0378101 A1 Dec. 1, 2022

(30) Foreign Application Priority Data

May 28, 2021 (CN) ..... 202121204443.4

(51) Int. Cl.
*A24F 40/46* (2020.01)
*A24F 40/485* (2020.01)

(52) U.S. Cl.
CPC ..... *A24F 40/46* (2020.01); *A24F 40/485* (2020.01)

(58) Field of Classification Search
CPC ..... A24F 40/46; A24F 40/485
USPC ..... 131/329
See application file for complete search history.

(56) References Cited

U.S. PATENT DOCUMENTS 9,498,588 B2 * 11/2016 Benassayag ..... A61M 15/06
10,244,793 B2 * 4/2019 Monsees ..... H05B 3/146
10,806,179 B2 * 10/2020 Bajpai ..... A24F 40/46
2017/0280775 A1 * 10/2017 Manca ..... A24F 40/485
2017/0280776 A1 * 10/2017 Manca ..... H05B 3/44

FOREIGN PATENT DOCUMENTS

CA 3051417 C * 3/2021 ..... A24F 40/40
CN 205757202 U * 12/2016
CN 210471007 U * 5/2020 ..... A24F 15/015
CN 210809291 U * 6/2020
CN 112006331 A * 12/2020 ..... A24F 40/10
CN 112189900 A * 1/2021 ..... A24F 1/32
CN 112353012 A * 2/2021 ..... A24F 40/10
CN 212814276 U * 3/2021
CN 213029735 U * 4/2021 ..... A24F 40/10
CN 213286766 U * 5/2021 ..... A24F 40/40
WO WO-2016165057 A1 * 10/2016 ..... A24F 47/00

* cited by examiner

*Primary Examiner* — Peter G Leigh
(74) *Attorney, Agent, or Firm* — Birchwood IP

(57) ABSTRACT

Disclosed is an atomization device, including: a heating wire, a glass heating core and a ceramic base; the ceramic base is provided with an open heating core accommodating part, the glass heating core is arranged in the heating core accommodating part, and a liquid-dipping end of the glass heating core protrudes from an opening of the heating core accommodating part and is exposed from the heating core accommodating part; a base body air channel is provided at the ceramic base; the glass heating core is provided with a heating core air channel, the heating core air channel is provided with an heating core air inlet hole, and the heating core air channel is peripherally covered with the heating wire. Oil to be atomized is dipped and the atomization airflow is formed through the base body air channel and the heating core air channel to meet user's demand for oil atomization.

11 Claims, 7 Drawing Sheets

ATOMIZATION DEVICE

TECHNICAL FIELD

The present application relates to an atomization device.

BACKGROUND

Electronic cigarette devices typically contain e-liquid which is atomized by heating, thus producing an inhalable vapor or aerosol. Electronic cigarette devices on the market usually include a porous ceramic body with a large number of micropores inside for absorbing and transmitting the above-mentioned e-liquid, and a heating element is arranged on one surface of the porous ceramic body to heat and atomize the absorbed e-liquid. On the one hand, the micropores in the porous body serve as the channel for the e-liquid to infiltrate and flow to the atomization surface, on the other hand, the micropores are used as an air exchange channel for supplying air from the outside into the oil storage chamber to maintain the air pressure balance in the oil storage chamber after the e-liquid is consumed in the oil storage chamber, such that when the e-liquid is heated and atomized, bubbles will be generated in the porous ceramic body, and then the bubbles will emerge from the oil suction surface and enter the oil storage chamber.

It is a common practice in the electronic cigarette industry to use the porous ceramic body with microporous as part of the electronic cigarette atomization device, and in recent years, in order to further accurately control the burning speed of e-liquid and optimize the taste of smoking, porous glass as part of the electronic cigarette device has begun to be used in the electronic cigarette industry. For the atomization device using porous glass, the structure of the atomizer needs to be improved so that it can be adapted to the porous glass as a heating element, and meanwhile, it has the advantages of simple manufacture and convenient use.

SUMMARY

In order to overcome the problems existing in the related technology, the application provides an atomization device, in which the oil to be atomized is dipped through the liquid-dipping end of the glass heating core, and the glass heating core is heated by the heating wire for atomization, and the atomization airflow is formed through the base body air channel and the heating core air channel to meet the user's demand for oil atomization.

In order to solve the above-mentioned technical problems, the technical scheme adopted in the present application is as follows:

An atomization device is provided, which includes: a heating wire, a glass heating core and a ceramic base; the ceramic base is provided with an open heating core accommodating part, the glass heating core is arranged in the heating core accommodating part, and a liquid-dipping end of the glass heating core protrudes from an opening of the heating core accommodating part and is exposed from the heating core accommodating part; a base body air channel communicated with the heating core accommodating part is provided at an opposite side of the ceramic base with an opening; the glass heating core is provided with a heating core air channel that communicates with the base body air channel, the heating core air channel is provided with an heating core air inlet hole at the liquid-dipping end, and at least part of the heating core air channel is peripherally covered with the heating wire.

Preferably, the heating core air channel includes a longitudinal air channel, and the longitudinal air channel is connected to an end face of the liquid-dipping end of the glass heating core and the base body air channel; the heating core accommodating part is provided with a heating wire supporting part, and the heating wire supporting part is provided with an insertion hole corresponding to a position of a pin of the heating wire.

Preferably, the heating core air channel includes a longitudinal air channel and a transverse air channel arranged at the glass heating core, one end of the longitudinal air channel communicates with the base body air channel, and the other end of the longitudinal air channel communicates with the transverse air channel, the transverse air channel communicates the longitudinal air channel with an outer periphery of the liquid-dipping part, and the transverse air channel forms at least one heating core air inlet hole at the outer periphery of the liquid-dipping part; the heating wire includes a heating helical part, the heating helical part is embedded in the glass heating core, and the heating helical part is wrapped to form a heating area, and the heating area wraps a part of the transverse air channel.

Preferably, the transverse air channel runs through the glass heating core, and two heating core air inlet holes are provided at the outer periphery of the liquid-dipping end, and the transverse air channel and the longitudinal air channel are arranged in a staggered manner.

Preferably, an end part of the liquid-dipping end is provided with an arc-shaped chamfer, and the arc-shaped chamfer is concentric with the transverse air channel.

Preferably, a first pumping core positioning part matched with the heating core air inlet hole is provided at the opening of the heating core accommodating part.

Preferably, a cross section of the transverse air channel is circular, the first pumping core positioning part is concentric with the transverse air channel, and the first pumping core positioning part is a semicircular or an arc-shaped notch.

Preferably, the heating core accommodating part is provided with a second pumping core support, the second pumping core support is provided with a second pumping core hole, and the second pumping core hole is matched with the longitudinal air channel.

Preferably, an outer periphery of one end of the ceramic base provided with the base body air channel is provided with a connecting thread part, and a diameter of the connecting thread part is smaller than an outer diameter of the heating core accommodating part.

Preferably, the glass heating core is made of porous glass, and the glass heating core includes a plurality of glass particles, and the diameter of the glass particles is less than 0.1 mm.

The technical solution provided by the present application can include the following beneficial effects: an atomization device is disclosed, which includes: a heating wire, a glass heating core and a ceramic base; the ceramic base is provided with an open heating core accommodating part, the glass heating core is arranged in the heating core accommodating part, and a liquid-dipping end of the glass heating core protrudes from an opening of the heating core accommodating part and is exposed from the heating core accommodating part; a base body air channel communicated with the heating core accommodating part is provided at an opposite side of the ceramic base with an opening; the glass heating core is provided with a heating core air channel that communicates with the base body air channel, the heating core air channel is provided with an heating core air inlet hole at the liquid-dipping end, and at least part of the heating core air channel is peripherally covered with the heating wire. In the atomization device, the oil to be atomized is dipped through the liquid-dipping end of the glass heating core, and the glass heating core is heated by the heating wire for atomization, and the atomization airflow is formed through the base body air channel and the heating core air channel to meet the user's demand for oil atomization.

It should be understood that both the foregoing general description and the following detailed description are exemplary and explanatory only and are not intended to limit the present application.

BRIEF DESCRIPTION OF DRAWINGS

The above and other objects, features and advantages of the present application will become more apparent from the detailed description of the exemplary embodiments of the present application in conjunction with the accompanying drawings, in the exemplary embodiments of the present application, the same reference numerals generally represent the same components.

REFERENCE NUMERALS

Figure 1:
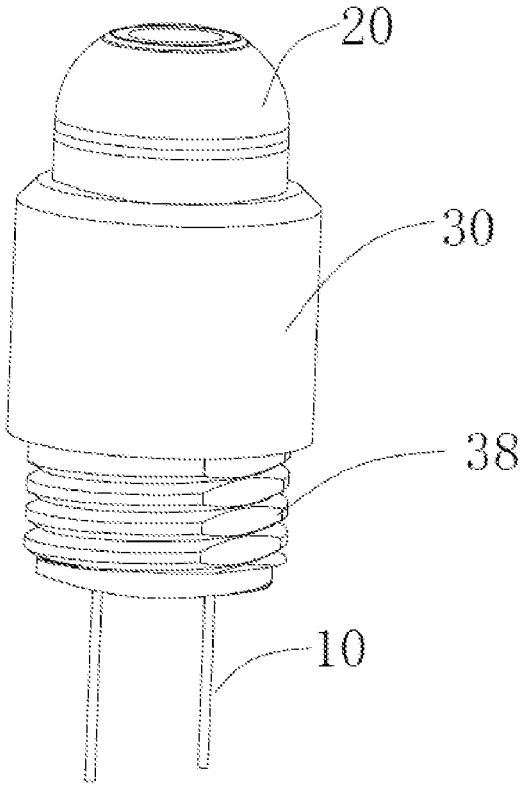
FIG. 1 is a schematic diagram of the overall structure according to Embodiment 1 of the present application.

| Numerals | Features |
|---|---|
| 10 | heating wire |
| 11 | heating helical part |
| 12 | pin |
| 20 | glass heating core |
| 22 | longitudinal air channel |
| 23 | transverse air channel |
| 24 | heating core air inlet hole |
| 25 | arc-shaped chamfer |
| 30 | ceramic base |
| 31 | base body air channel |
| 32 | heating core accommodating part |
| 33 | heating wire supporting part |
| 34 | insertion hole |
| 35 | first pumping core positioning part |
| 36 | second pumping core support |
| 37 | second pumping core hole |
| 38 | connecting thread part |

DETAILED DESCRIPTION

The embodiments of the present application are described in detail below, examples of which are illustrated in the accompanying drawings, in which the same or similar reference numerals refer to the same or similar elements or elements having the same or similar functions throughout. The embodiments described below with reference to the accompanying drawings are exemplary, and are intended to be used to explain the present application, but should not be construed as a limitation to the present application.

In the present application, unless otherwise expressly specified and defined, terms such as "installed", "connected with", "connected to", "fixed" should be understood in a broad sense, for example, it may be a fixed connection, a detachable connection, or an integral connection; it may be a mechanical connection or an electrical connection; it may be a direct connection, an indirect connection through an intermediate medium, or an internal connection between two components. For those having ordinary skill in the art, the specific meanings of the above terms in the present application can be understood according to specific situations.

In the present application, unless otherwise expressly specified and defined, a first feature being "on" or "under" a second feature may include the first and second features are in direct contact, it may also be included that the first and second features are not in direct contact but are in contact through another feature therebetween. Further, the first feature being "above", "over" and "onto" the second feature includes the first feature being directly above and obliquely above the second feature, or simply means that the first feature is level higher than the second feature. The first feature is "below", "under" and "underneath" the second feature includes the first feature being directly below and diagonally below the second feature, or simply means that the first feature has a lower level than the second feature.

The present application will be further described in detail below through specific embodiments with reference to the accompanying drawings.

EMBODIMENT 1

Figure 2:
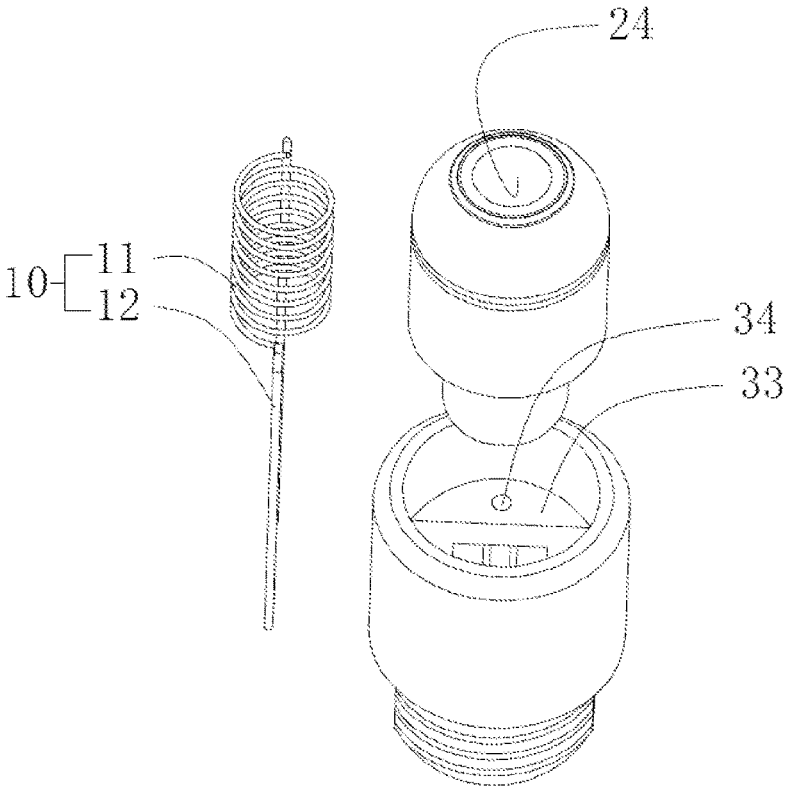
FIG. 2 is an exploded schematic diagram of the overall structure according to Embodiment 1 of the present application.
Figure 3:
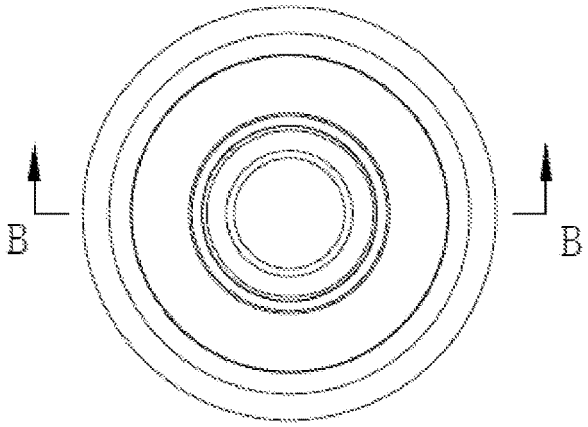
FIG. 3 is a schematic top view of the overall structure according to Embodiment 1 of the present application.
Figure 4:
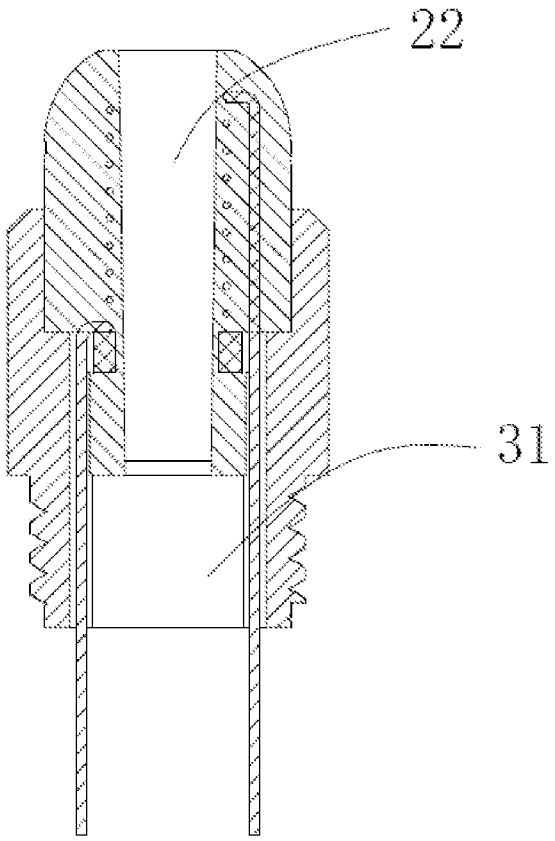
FIG. 4 is a schematic cross-sectional view at B-B in FIG. 3 according to Embodiment 1 of the present application.

Referring to FIGS. 1 to 4, an atomization device is provided, which includes: a heating wire 10, a glass heating core 20 and a ceramic base 30; the ceramic base 30 is provided with an open heating core accommodating part 32, the glass heating core 20 is arranged in the heating core accommodating part 32, and a liquid-dipping end of the glass heating core 20 protrudes from an opening of the heating core accommodating part 32 and is exposed from the heating core accommodating part 32; an opposite side of the ceramic base 30 with an opening is provided with a base body air channel 31 communicated with the heating core accommodating part 32; the glass heating core 20 is provided with a heating core air channel that communicates with the base body air channel 31, the heating core air channel is provided with an heating core air inlet hole 24 at the liquid-dipping end, and at least part of the heating core air channel is peripherally covered with the heating wire 10.

Specifically, the heating core air channel includes a longitudinal air channel 22, and the longitudinal air channel 22 is connected to an end face of the liquid-dipping end of the glass heating core 20 and the base body air channel 31; the heating core accommodating part 32 is provided with a heating wire supporting part 33, and the heating wire supporting part 33 is provided with an insertion hole 34 corresponding to a position of a pin 12 of the heating wire 10, the heating wire supporting part 33 is used to support and limit the position of the heating wire 10 in the process of sintering the atomizing device, so that the heating wire 10 is in a proper position in the sintering mold.

EMBODIMENT 2

Figure 5:
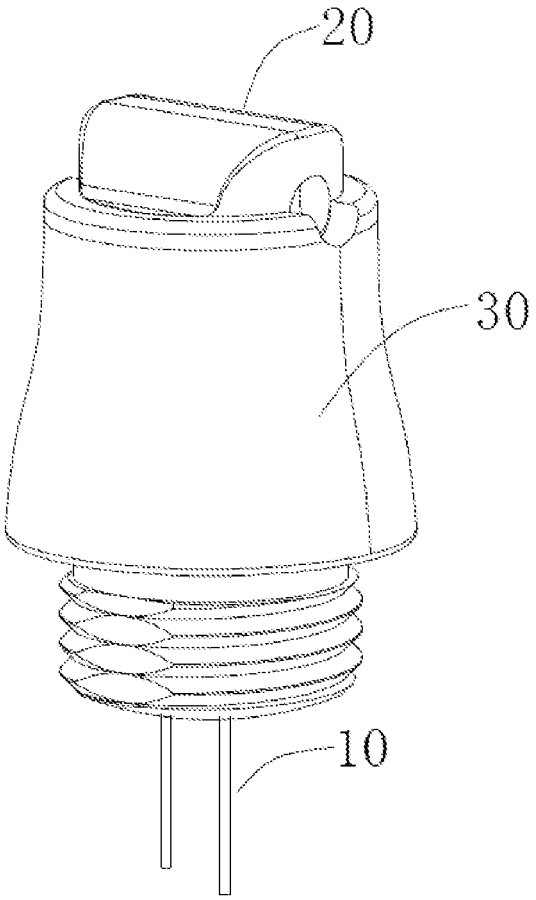
FIG. 5 is a schematic diagram of the overall structure according to Embodiment 2 of the present application.
Figure 6:
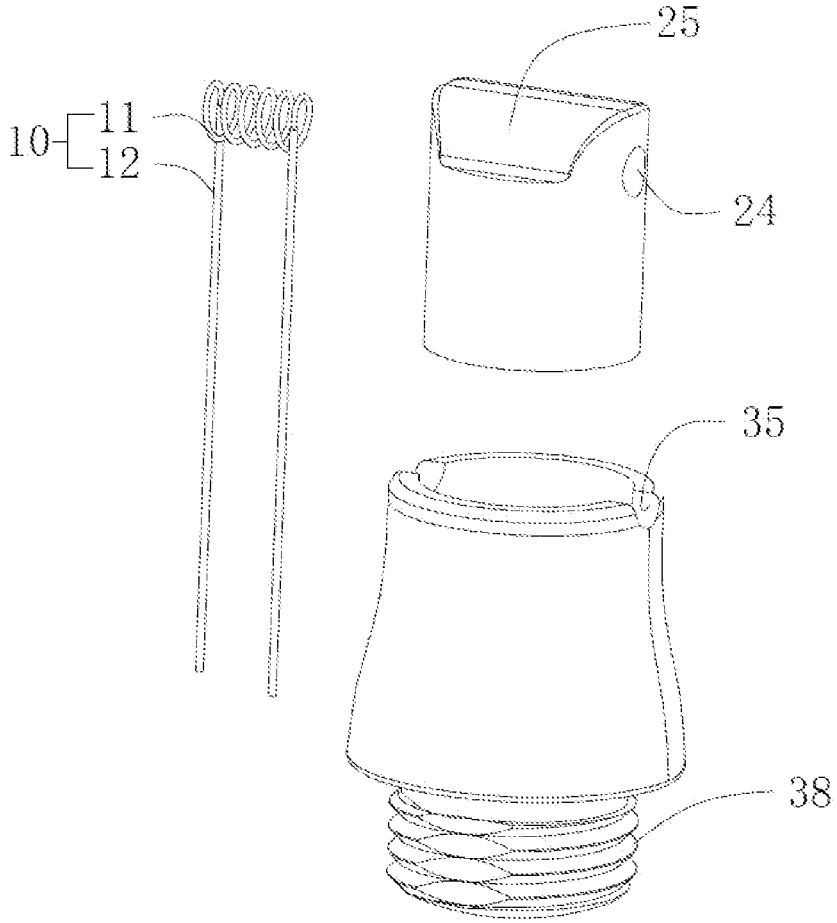
FIG. 6 is an exploded schematic diagram of the overall structure according to Embodiment 2 of the present application.
Figure 7:
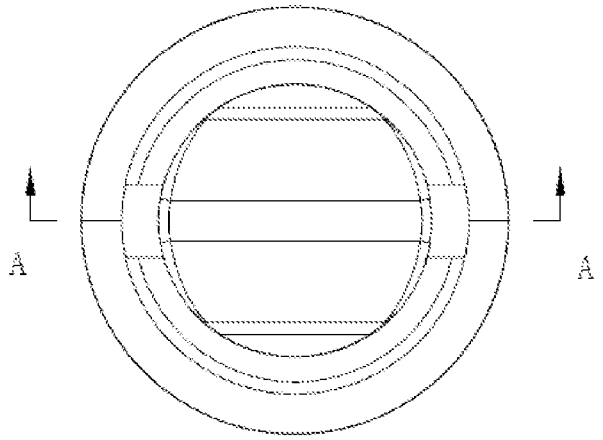
FIG. 7 is a schematic top view of the overall structure according to Embodiment 2 of the present application.
Figure 8:
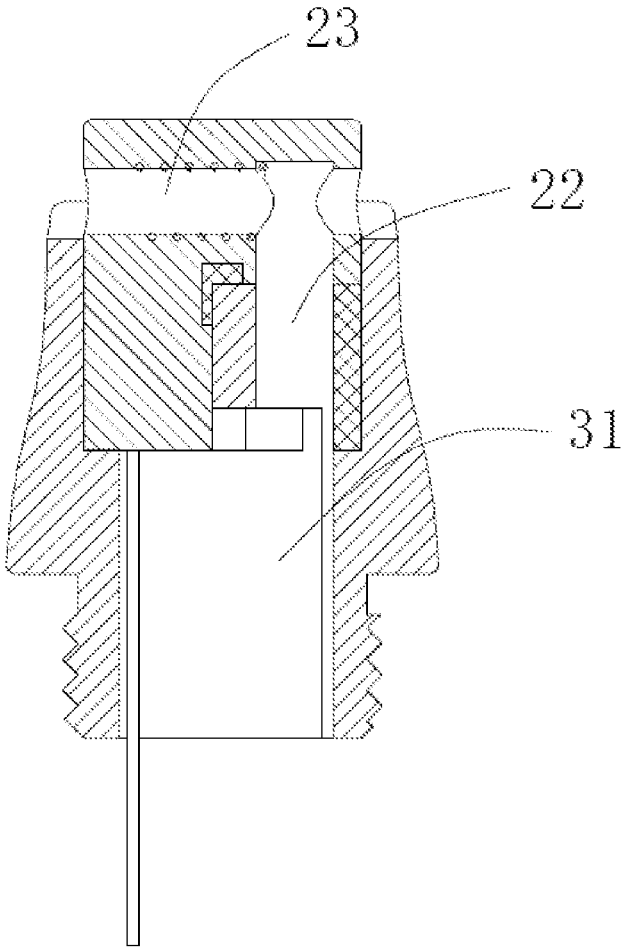
FIG. 8 is a schematic cross-sectional view at A-A in FIG. 7 according to Embodiment 2 of the present application.
Figure 9:
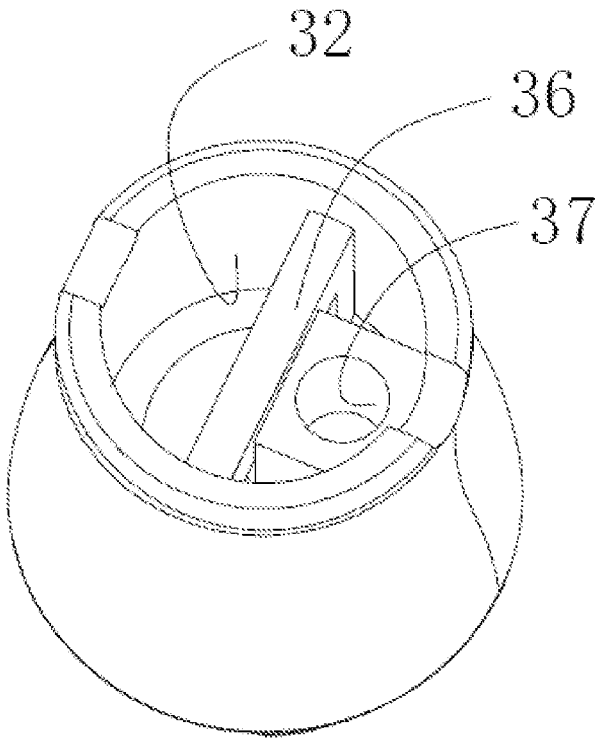
FIG. 9 is a schematic diagram of the overall structure of the ceramic base according to Embodiment 2 of the present application.

Referring to FIGS. 5 to 9, an atomization device is provided, which includes: a heating wire 10, a glass heating core 20 and a ceramic base 30; the ceramic base 30 is provided with an open heating core accommodating part 32, the glass heating core 20 is arranged in the heating core accommodating part 32, and a liquid-dipping end of the glass heating core 20 protrudes from an opening of the heating core accommodating part 32 and is exposed from the heating core accommodating part 32; an opposite side of the ceramic base 30 with an opening is provided with a base body air channel 31 communicated with the heating core accommodating part 32; the glass heating core 20 is provided with a heating core air channel that communicates with the base body air channel 31, the heating core air channel is provided with an heating core air inlet hole 24 at the liquid-dipping end, and at least part of the heating core air channel is peripherally covered with the heating wire 10.

Specifically, the heating core air channel includes a longitudinal air channel 22 and a transverse air channel 23 arranged at the glass heating core 20, one end of the longitudinal air channel 22 communicates with the base body air channel 31, and the other end of the longitudinal air channel 22 communicates with the transverse air channel 23, the transverse air channel 23 communicates the longitudinal air channel 22 with an outer periphery of the liquid-dipping part, and the transverse air channel 23 forms at least one heating core air inlet hole 24 at the outer periphery of the liquid-dipping part;

the heating wire 10 includes a heating helical part 11, the heating helical part 11 is embedded in the glass heating core 20, and the heating helical part 11 is wrapped to form a heating area, and the heating area wraps a part of the transverse air channel.

In order to increase the amount of intake air, the transverse air channel 23 runs through the glass heating core 20, and two heating core air inlet holes 24 are provided at the outer periphery of the liquid-dipping end, and the transverse air channel 23 and the longitudinal air channel 22 are arranged in a staggered manner.

In order to increase the area of the liquid-dipping end for absorbing oil, an end part of the liquid-dipping end is provided with an arc-shaped chamfer 25, and further, in order to evenly heat the oil dipped at the liquid-dipping end, the arc-shaped chamfer 25 is arranged concentric with the transverse air channel 23.

In order to facilitate the core pulling and positioning of the core during the sintering process, a first pumping core positioning part 35 matched with the heating core air inlet hole 24 is provided at the opening of the heating core accommodating part 32. As a preferred embodiment, a cross section of the transverse air channel 23 is circular, the first pumping core positioning part 35 is concentric with the transverse air channel 23, and the first pumping core positioning part 35 is a semicircular or an arc-shaped notch.

Similarly, the heating core accommodating part 32 is provided with a second pumping core support 36, the second pumping core support 36 is provided with a second pumping core hole 37, and the second pumping core hole 37 is matched with the longitudinal air channel 22.

The atomization device may need to be connected to a atomizer host, in order to facilitate the assembly with the atomizer host, an outer periphery of one end of the ceramic base 30 provided with the base body air channel 31 is provided with a connecting thread part 38, and a diameter of the connecting thread part 38 is smaller than an outer diameter of the heating core accommodating part 32.

Preferably, the glass heating core 20 is made of porous glass, and the glass heating core 20 includes a plurality of glass particles, and the diameter of the glass particles is less than 0.1 mm.

In the specification of the present application, the terms "one implementation", "some implementations", "one embodiment", "some embodiments" "example," "specific example" or "some examples," etc. are intended that a particular feature, structure, material or characteristic described in connection with the embodiment or example is included in at least one embodiment or example of the present application. In this specification, schematic representations of the above terms do not necessarily refer to the same embodiment or example. Furthermore, the particular features, structures, materials or characteristics described may be combined in any suitable manner in any one or more embodiments or examples.

The above content is a further detailed description of the present application in conjunction with specific embodiments, and it cannot be considered that the specific implementation of the present application is limited to these descriptions. For those having ordinary skill in the art to which the present application relates, some simple deductions or substitutions can be made without departing from the concept of the present application.

What is claimed is:

1. An atomization device, comprising: a heating wire, a glass heating core and a ceramic base;

the ceramic base is provided with an open heating core accommodating part, the glass heating core is arranged in the heating core accommodating part, and a liquid-dipping end of the glass heating core protrudes from an opening of the heating core accommodating part and is exposed from the heating core accommodating part;

a base body air channel communicated with the heating core accommodating part is provided at an opposite side of the ceramic base with an opening;

the glass heating core is provided with a heating core air channel that communicates with the base body air channel, the heating core air channel is provided with a heating core air inlet hole at the liquid-dipping end, and at least part of the heating core air channel is peripherally covered with the heating wire.

2. The atomization device of claim 1, wherein, the heating core air channel comprises a longitudinal air channel, and the longitudinal air channel is connected to an end face of the liquid-dipping end of the glass heating core and the base body air channel; the heating core accommodating part is provided with a heating wire supporting part, and the heating wire supporting part is provided with an insertion hole corresponding to a position of a pin of the heating wire.

3. The atomization device of claim 1, wherein, the heating core air channel comprises a longitudinal air channel and a transverse air channel arranged at the glass heating core, one end of the longitudinal air channel communicates with the base body air channel, and the other end of the longitudinal air channel communicates with the transverse air channel, the transverse air channel communicates the longitudinal air channel with an outer periphery of the liquid-dipping part, and the transverse air channel forms at least one heating core air inlet hole at the outer periphery of the liquid-dipping part;

the heating wire comprises a heating helical part, the heating helical part is embedded in the glass heating core, and the heating helical part is wrapped to form a heating area, and the heating area wraps a part of the transverse air channel.

4. The atomization device of claim 3, wherein, the transverse air channel runs through the glass heating core, and two heating core air inlet holes are provided at the outer periphery of the liquid-dipping end, and the transverse air channel and the longitudinal air channel are arranged in a staggered manner.

5. The atomization device of claim 3, wherein, an end part of the liquid-dipping end is provided with an arc-shaped chamfer, and the arc-shaped chamfer is concentric with the transverse air channel.

6. The atomization device of claim 3, wherein, a first pumping core positioning part matched with the heating core air inlet hole is provided at the opening of the heating core accommodating part.

7. The atomization device of claim 6, wherein, a cross section of the transverse air channel is circular, the first pumping core positioning part is concentric with the transverse air channel, and the first pumping core positioning part is a semicircular or an arc-shaped notch.

8. The atomization device of claim 3, wherein, the heating core accommodating part is provided with a second pumping core support, the second pumping core support is provided with a second pumping core hole, and the second pumping core hole is matched with the longitudinal air channel.

9. The atomization device of claim 2, wherein, an outer periphery of one end of the ceramic base provided with the base body air channel is provided with a connecting thread part, and a diameter of the connecting thread part is smaller than an outer diameter of the heating core accommodating part.

10. The atomization device of claim 1, wherein, the glass heating core is made of porous glass, and the glass heating core comprises a plurality of glass particles, and the diameter of the glass particles is less than 0.1 mm.

11. The atomization device of claim 3, wherein, an outer periphery of one end of the ceramic base provided with the base body air channel is provided with a connecting thread part, and a diameter of the connecting thread part is smaller than an outer diameter of the heating core accommodating part.

* * * * *